US011603997B2

(12) United States Patent
Hirokawa et al.

(10) Patent No.: US 11,603,997 B2
(45) Date of Patent: Mar. 14, 2023

(54) HEAT EXCHANGER AND AIR CONDITIONER

(71) Applicant: DAIKIN INDUSTRIES, LTD., Osaka (JP)

(72) Inventors: Tomoki Hirokawa, Osaka (JP); Satoshi Inoue, Osaka (JP); Shun Yoshioka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 79 days.

(21) Appl. No.: 17/043,125

(22) PCT Filed: Mar. 22, 2019

(86) PCT No.: PCT/JP2019/012199
§ 371 (c)(1),
(2) Date: Sep. 29, 2020

(87) PCT Pub. No.: WO2019/188828
PCT Pub. Date: Oct. 3, 2019

(65) Prior Publication Data

US 2021/0018190 A1 Jan. 21, 2021

(30) Foreign Application Priority Data

Mar. 30, 2018 (JP) ..... JP2018-067324

(51) Int. Cl.
*F24F 1/18* (2011.01)
*F25B 39/00* (2006.01)
(Continued)

(52) U.S. Cl.
CPC ..... *F24F 1/18* (2013.01); *F25B 39/00* (2013.01); *F28D 1/053* (2013.01); *F28F 9/02* (2013.01)

(58) Field of Classification Search
CPC ..... F24F 1/18; F24F 9/02; F25B 39/00; F28D 1/053; F28F 9/02; F28F 9/0202;
(Continued)

(56) References Cited

U.S. PATENT DOCUMENTS 4,922,732 A 5/1990 Eriksson
6,732,789 B2 5/2004 Jang
(Continued)

FOREIGN PATENT DOCUMENTS

JP H11337293 A 12/1999
JP 2015-068622 A 4/2015
(Continued)

OTHER PUBLICATIONS

Attached pdf is translation of foreign reference JP 2017044428 A (Year: 2017).*
(Continued)

*Primary Examiner* — Henry T Crenshaw
*Assistant Examiner* — Kamran Tavakoldavani
(74) *Attorney, Agent, or Firm* — Osha Bergman Watanabe & Burton LLP

(57) ABSTRACT

A heat exchanger includes: a header that extends in a horizontal direction; and heat transfer tubes that extends in a direction crossing the horizontal direction, that are disposed side by side in a longitudinal direction of the header, and that are connected to the header. The header includes a first space that causes a refrigerant to flow in a first direction along the longitudinal direction of the header, a second space that causes the refrigerant to flow in a second direction along the longitudinal direction of the header and opposite to the
(Continued)

first direction, a circulation member extends in the longitudinal direction of the header and separates the first space from the second space, a first communication port, a second communication port, and an inflow port.

20 Claims, 13 Drawing Sheets

(51) Int. Cl.
*F28D 1/053* (2006.01)
*F28F 9/02* (2006.01)

(58) Field of Classification Search
CPC ..... F28F 9/0204; F28F 9/0207; F28F 9/0209; F28F 9/0212; F28F 9/0214; F28F 9/0217
See application file for complete search history.

(56) References Cited

U.S. PATENT DOCUMENTS

2016/0327343 A1* 11/2016 Hwang ..... F28D 1/0435
2016/0363392 A1 12/2016 Winterstten et al.

FOREIGN PATENT DOCUMENTS

JP 2017-044428 A 3/2017
JP 2017044428 A * 3/2017
JP 2019-052784 A 4/2019

OTHER PUBLICATIONS

Notification of Transmittal of Translation of the International Preliminary Report on Patentability issued in corresponding International Application No. PCT/JP2019/012199, dated Oct. 15, 2020 (1 page).
International Preliminary Report on Patentability issued in corresponding International Application No. PCT/JP2019/012199, dated Oct. 6, 2020 (9 pages).
International Search Report issued in International Application No. PCT/JP2019/012199, dated Jun. 18, 2019 (5 pages).
Written Opinion issued in International Application No. PCT/JP2019/012199, dated Jun. 18, 2019 (6 pages).
Extended European Search Report issued in the counterpart European Patent Application No. 19776093.7, dated Apr. 8, 2021 (8 pages).

* cited by examiner

HEAT EXCHANGER AND AIR CONDITIONER

TECHNICAL FIELD

The present invention relates to a heat exchanger and an air conditioner.

BACKGROUND

Hitherto, a known heat exchanger has included a plurality of heat transfer tubes, fins joined to the plurality of heat transfer tubes, and a header coupled to end portions of the plurality of heat transfer tubes, and has caused a refrigerant flowing in the heat transfer tubes to exchange heat with air flowing outside the heat transfer tubes.

For example, Patent Literature 1 (Japanese Unexamined Patent Application Publication No. 2015-068622) proposes a heat exchanger utilizing a structure that causes a refrigerant to circulate in a header so that even in either one of an environment in which a circulation amount is large and an environment in which a circulation amount is small, a refrigerant can be divided by and can flow to each of heat transfer tubes disposed side by side in an up-down direction.

Patent Literature 2 (Japanese Unexamined Patent Application Publication No. 2017-044428) proposes a heat exchanger including a header whose longitudinal direction is in a horizontal direction and heat transfer tubes used in a vertically extending orientation. This heat exchanger utilizes a structure that allows a refrigerant to be divided by and to flow to a plurality of heat transfer tubes by, while partitioning an internal space of the header into a first region that communicates with a portion of each heat transfer tube on one side and a second region that communicates with a portion of each heat transfer tube on the other side, causing the refrigerant to flow from both ends of the header in the longitudinal direction into the respective regions.

In the heat exchanger described in Patent Literature 1 above, since the longitudinal direction of the header is in the vertical direction, in order to cause the refrigerant to be divided by and to flow into the plurality of heat transfer tubes, the refrigerant needs to be supplied upward so as to oppose its own weight, as a result of which it may be difficult to sufficiently circulate the refrigerant in the header. In addition, even if the heat exchanger described in Patent Literature 1 above is used so that the longitudinal direction of the header is in the horizontal direction, when the refrigerant is caused to circulate in the header, a portion to which the refrigerant is moved upward so as to oppose its own weight is required. Therefore, it becomes difficult to sufficiently circulate the refrigerant in the header and the refrigerant may be drift.

In the heat exchanger described in Patent Literature 2 above, a liquid refrigerant gathers near the center of the header in the longitudinal direction and the refrigerant may drift.

SUMMARY

One or more embodiments of the present invention provide a heat exchanger and an air conditioner that are capable of suppressing drift of a refrigerant in a plurality of heat transfer tubes.

A heat exchanger according to one or more embodiments includes a header and a plurality of heat transfer tubes. The header extends in a horizontal direction. The heat transfer tubes extend in a direction that crosses the horizontal direction in which the header extends. The plurality of heat transfer tubes are disposed side by side in a longitudinal direction of the header. The plurality of heat transfer tubes are connected to the header. The header includes a first space, a second space, a circulation member, a first communication port, a second communication port, and an inflow port. The first space allows the refrigerant to flow in a first direction along the longitudinal direction of the header. The second space allows the refrigerant to flow in a second direction. The second space is provided so as to include a portion that is disposed side by side with the first space in the horizontal direction. The second direction is a direction along the longitudinal direction of the header and is a direction opposite to the first direction. The circulation member extends so as to separate the first space and the second space from each other while extending in the longitudinal direction of the header. The first communication port allows the first space and the second space to communicate with each other in the header. The second communication port allows the first space and the second space to communicate with each other in the header at a position in the second direction with respect to the first communication port. The inflow port allows the refrigerant to flow into the header. The first space and/or the second space is directly or indirectly connected to the heat transfer tubes.

Here, "horizontal direction", which is the direction in which the header extends, is not limited to a perfectly horizontal direction, and also encompasses a tilt within a range of ±30 with respect to the horizontal direction.

Longitudinal direction of the circulation member when viewed in the longitudinal direction of the header (when viewed in a cross section in a direction in which the refrigerant passes inside the header) is not limited, and, for example, may be within ±45 degrees or may be within ±30 with respect to the vertical direction. Note that when the position of a lower end of the first space and the position of a lower end of the second space in a height direction differ from each other due to the longitudinal direction of the circulation member being tilted when viewed in the longitudinal direction of the header, a space on a side at which the inflow port is connected is situated on a lower side. This may be from the viewpoint of making it easier to circulate the refrigerant.

Although the circulation member is not limited, for example, one end of the circulation member may be extended up to an inner surface of the inside of the header on an opposite side to a side at which the heat transfer tubes are connected.

Note that the heat transfer tubes may extend upward or downward from the header.

In the heat exchanger, when the refrigerant that has flowed into the header via the inflow port is caused to be divided by and to flow into the plurality of heat transfer tubes, the refrigerant is capable of being circulated in the first space, the first communication port, the second space, and the second communication port in this order. Moreover, since the header extends in the horizontal direction, the refrigerant circulating in the header moves primarily in the horizontal direction and the amount of movement in the height direction is suppressed. Therefore, it is possible to circulate the refrigerant in the header with the likelihood of the refrigerant being influenced by gravity being decreased. Consequently, it is possible to suppress the refrigerant from stagnating at a particular portion of the header in the longitudinal direction and to equalize the distribution of the refrigerant with respect to the plurality of heat transfer tubes that are positioned in the longitudinal direction of the header.

In a heat exchanger according to one or more embodiments, the plurality of heat transfer tubes are connected to the header so that an end portion of each heat transfer tube communicates with both the first space and the second space of the header.

Here, an end portion of one heat transfer tube on a side connected to the header communicates with both the first space and the second space in the header. When one heat transfer tube has one flow path, the one flow path communicates with both the first space and the second space, and when one heat transfer tube has a plurality of flow paths, the plurality of flow paths as a whole communicate with both the first space and the second space (some of the plurality of flow paths may communicate primarily with the first space and the other ones of the plurality of flow paths may communicate primarily with the second space).

The heat exchanger makes it possible to supply to the heat transfer tubes both the refrigerant flowing in the first flow path and the refrigerant flowing in the second flow path. Therefore, for example, even if a deviation occurs in the distribution of a liquid refrigerant in the longitudinal direction of header in the first flow path, when a different deviation occurs in the distribution of the liquid refrigerant in the longitudinal direction of the header in the second flow path, it is possible to cancel out the deviations of the liquid refrigerants in these spaces.

In a heat exchanger according to one or more embodiments, the inflow port is an opening allowing the refrigerant to flow into the first space of the header. The plurality of heat transfer tubes are connected to the header so that an end portion of each heat transfer tube communicates with the first space of the header and does not communicate with the second space.

In the heat exchanger, since the internal space of the header is divided by the circulation member, a refrigerant passage area of the first space in which the refrigerant that has passed through the inflow port passes can be made smaller than the internal space of the header when viewed in the longitudinal direction. Therefore, it is possible to suppress reduction in the flow speed of the refrigerant flowing in the first space. Consequently, even in an environment in which the circulation amount of the refrigerant is relatively small, the refrigerant that has passed through the inflow port and that has been supplied to the first space easily reaches not only the heat transfer tubes that are connected to the vicinity of the inflow port in the first space but also the heat transfer tubes that are connected at positions situated away from the inflow port in the first space. Consequently, it is possible to suppress to a small amount drift of the refrigerant between the plurality of heat transfer tubes that are provided side by side in the longitudinal direction of the header.

In a heat exchanger according to one or more embodiments, the inflow port is an opening allowing the refrigerant to flow into the first space of the header. The plurality of heat transfer tubes are connected to the header so that an end portion of each heat transfer tube communicates with the second space of the header and does not communicate with the first space.

In the heat exchanger, the heat transfer tubes are not connected to the first space in which the refrigerant that has passed through the inflow port passes. Therefore, in an environment in which the circulation amount of the refrigerant is relatively large, even if the refrigerant passes the vicinity of the inflow port at a relatively high flow speed, since the heat transfer tubes are not connected to the first space, it is possible to suppress occurrence of a case in which the refrigerant is less likely to be supplied to the heat transfer tubes due to the refrigerant passing through inlets of the heat transfer tubes quickly at a flow speed that is too high. The liquid refrigerant that has passed through the first space at a relatively high flow speed and that has reached a portion situated far from the inflow port is supplied to the second space with its flow speed decreased to a proper speed via the first communication port, and thus is capable of being properly divided by and of flowing into each heat transfer tube that is connected to the second space.

In a heat exchanger according to one or more embodiments, the header further includes a third space, a third space member, and a third communication port. The third space is positioned between the first space and the second space and a connecting portion at which the plurality of heat transfer tubes and the header are connected to each other, or between the first space and the connecting portion at which the plurality of heat transfer tubes and the header are connected to each other, or between the second space and the connecting portion at which the plurality of heat transfer tubes and the header are connected to each other. Here, the heat exchanger features any one of (1) to (5) below.

(1) The third space is positioned between the first space and the second space and the connecting portion at which the plurality of heat transfer tubes and the header are connected to each other, and the first space and the second space are separated from the third space by a third space member so that the first space and the third space communicate with each other via a third communication port.

(2) The third space is positioned between the first space and the second space and the connecting portion at which the plurality of heat transfer tubes and the header are connected to each other, and the first space and the second space are separated from the third space by the third space member so that the second space and the third space communicate with each other via a third communication port.

(3) The third space is positioned between the first space and the second space and the connecting portion at which the plurality of heat transfer tubes and the header are connected to each other, and the first space and the second space are separated from the third space by the third space member so that the first space and the third space communicate with each other via one of the third communication ports and the second space and the third space communicate with each other via a different one of the third communication ports.

(4) The third space is positioned between the first space and the connecting portion at which the plurality of heat transfer tubes and the header are connected to each other, and the first space and the third space are separated from each other by a third space member so that the first space and the third space communicate with each other via a third communication port.

(5) The third space is positioned between the second space and the connecting portion at which the plurality of heat transfer tubes and the header are connected to each other, and the second space and the third space are separated from each other by a third space member so that the second space and the third space communicate with each other via a third communication port.

In the heat exchanger, the refrigerant that has flowed in the first space or the second space passes through the third space via the third communication port formed in the third space member before being sent to the plurality of heat transfer tubes. Therefore, the refrigerant that has flowed in the first space or the second space can be stirred in the third space before being sent to the heat transfer tubes. Therefore, it is possible to suppress drift of the refrigerant between the plurality of heat transfer tubes.

In a heat exchanger according to one or more embodiments, the plurality of heat transfer tubes are disposed side by side in a direction in which the first space and the second space are disposed side by side. The plurality of heat transfer tubes are connected to the third space of the header.

Note that, here, the plurality of heat transfer tubes, while being disposed side by side in the longitudinal direction of the header, are also disposed in the direction in which the first space and the second space are disposed side by side and form rows and columns.

In the heat exchanger, while the plurality of heat transfer tubes are disposed side by side in the direction in which the first space and the second space are disposed side by side, the heat transfer tubes that are disposed at different positions in the direction in which the first space and the second space are disposed side by side are each connected to the same third space. Therefore, it is possible to suppress drift of the refrigerant between the heat transfer tubes that are disposed at different positions in the direction in which the first space and the second space are disposed.

In a heat exchanger according to one or more embodiments, a tilt angle with respect to a vertical direction, which is a direction in which the plurality of heat transfer tubes extend, is less than or equal to 45 degrees.

In the heat exchanger, since the tilt angle with respect to the vertical direction, which is the direction in which the plurality of heat transfer tubes extend, is less than or equal to 45 degrees, even if the liquid refrigerant has reached the inlets of the heat transfer tubes, it is possible to suppress the liquid refrigerant from drifting and flowing to a portion that is positioned at a lower side in the flow paths in the heat transfer tubes, and to make uniform the refrigerant distribution at the entire inner peripheral surface of the flow paths in the heat transfer tubes.

In a heat exchanger according to one or more embodiments, the heat transfer tubes are flat tubes or circular tubes. In the flat tubes, a longitudinal direction in cross section thereof is a direction in which the first space and the second space are disposed side by side. A cross section of the circular tubes is circular.

In the heat exchanger, when the heat transfer tubes are flat tubes and are used by causing air to flow in the direction in which the first space and the second space are disposed side by side, a wide heat transfer area in the direction of air flow is easily ensured. When the heat transfer tubes are circular tubes, the refrigerants that are supplied from both the first space and the second space are mixed and flow easily.

An air conditioner according to one or more embodiments includes a refrigerant circuit including the heat exchanger according to any one of the above embodiments.

This air conditioner is capable of improving capacity when a refrigeration cycle is executed in the refrigerant circuit.

DETAILED DESCRIPTION

One or more embodiments of a heat exchanger and an air conditioner and modifications thereof are described below based on the drawings.

(1) Structure of Air Conditioner

Figure 1:
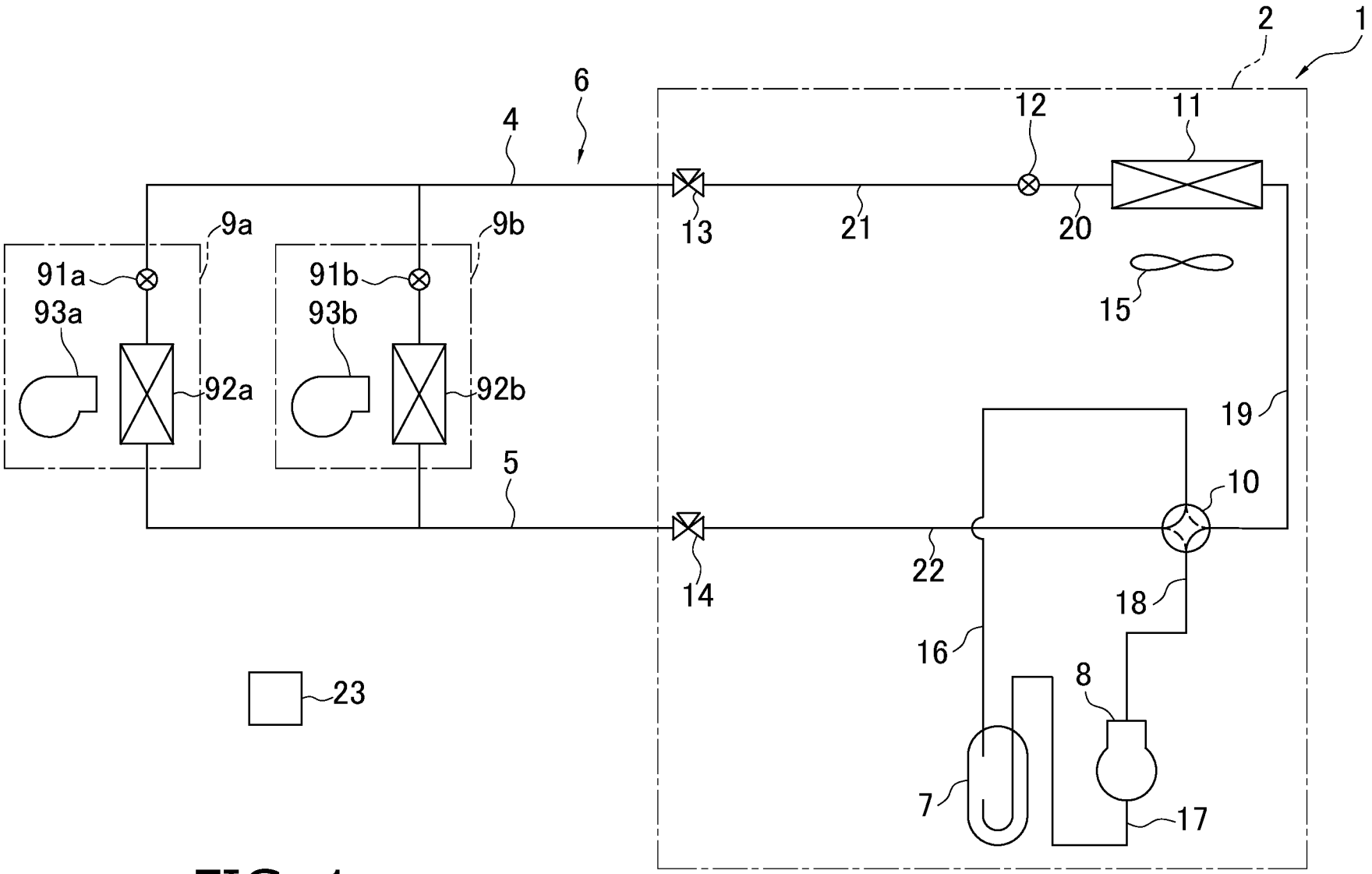
FIG. 1 is a schematic structural view of an air conditioner utilizing a heat exchanger according to one or more embodiments.

FIG. 1 is a schematic structural view of an air conditioner 1 utilizing an outdoor heat exchanger 11 as the heat exchanger according to one or more embodiments.

The air conditioner 1 is a device that is capable of cooling and heating the inside of, for example, a building by performing a vapor-compression refrigeration cycle. The air conditioner 1 primarily includes an outdoor unit 2, indoor units 9*a* and 9*b*, a liquid-refrigerant connection pipe 4 and a gas-refrigerant connection pipe 5 that connect the outdoor unit 2 and the indoor units 9*a* and 9*b* to each other, and a control unit 23 that controls structural devices of the outdoor unit 2 and the indoor units 9*a* and 9*b*. The vapor-compression refrigerant circuit 6 of the air conditioner 1 is formed by connecting the outdoor unit 2 and the indoor units 9*a* and 9*b* to each other via the refrigerant connection pipes 4 and 5.

The outdoor unit 2 is installed outside (for example, on the roof of a building or near a wall surface of a building)

and constitutes a portion of the refrigerant circuit 6. The outdoor unit 2 primarily includes an accumulator 7, a compressor 8, a four-way switching valve 10, the outdoor heat exchanger 11, an outdoor expansion valve 12, serving as an expansion mechanism, a liquid-side shutoff valve 13, a gas-side shutoff valve 14, and an outdoor fan 15. Each device and each valve are connected to each other by refrigerant pipes 16 to 22 corresponding thereto.

The indoor units 9*a* and 9*b* are installed inside (for example, a sitting room or a ceiling space) and constitutes a part of the refrigerant circuit 6. The indoor unit 9*a* primarily includes an indoor expansion valve 91*a*, an indoor heat exchanger 92*a*, and an indoor fan 93*a*. The indoor unit 9*b* primarily includes an indoor expansion valve 91*b*, serving as an expansion mechanism, an indoor heat exchanger 92*b*, and an indoor fan 93*b*.

The refrigerant connection pipes 4 and 5 are refrigerant pipes that are constructed at the site when the air conditioner 1 is installed at an installation place of, for example, a building. One end of the liquid-refrigerant connection pipe 4 is connected to the liquid-side shutoff valve 13 of the outdoor unit 2 and the other end of the liquid-refrigerant connection pipe 4 is connected to a liquid-side end of the indoor expansion valve 91*a* of the indoor unit 9*a* and to a liquid-side end of the indoor expansion valve 91*b* of the indoor unit 9*b*. One end of the gas-refrigerant connection pipe 5 is connected to the gas-side shutoff valve 14 of the outdoor unit 2 and the other end of the gas-refrigerant connection pipe 5 is connected to a gas-side end of the indoor heat exchanger 92*a* of the indoor unit 9*a* and to a gas-side end of the indoor heat exchanger 92*b* of the indoor unit 9*b*.

The control unit 23 is constituted by communication connection with a control board or the like (not shown) provided in the outdoor unit 2 or the indoor units 9*a* and 9*b*. For convenience sake, FIG. 1 illustrates the control unit 23 at a position situated away from the outdoor unit 2 and the indoor units 9*a* and 9*b*. The control unit 23 controls structural devices 8, 10, 12, 15, 91*a*, 91*b*, 93*a*, and 93*b* of the air conditioner 1 (here, the outdoor unit 2 and the indoor units 9*a* and 9*b*), that is, controls the overall operation of the air conditioner 1.

(2) Operation of Air Conditioner

Next, the operation of the air conditioner 1 is described by using FIG. 1. The air conditioner 1 performs a cooling operation and a defrost operation, and a heating operation. In the cooling operation and the defrost operation, the refrigerant is caused to flow in the compressor 8, the outdoor heat exchanger 11, the outdoor expansion valve 12 and the indoor expansion valves 91*a* and 91*b*, and the indoor heat exchangers 92*a* and 92*b* in this order. In the heating operation, the refrigerant is caused to flow in the compressor 8, the indoor heat exchangers 92*a* and 92*b*, the indoor expansion valves 91*a* and 91*b* and the outdoor expansion valve 12, and the outdoor heat exchangers 11 in this order. Note that the cooling operation, the defrost operation, and the heating operation are performed by the control unit 23.

At the time of the cooling operation and at the time of the defrost operation, the four-way switching valve 10 is switched to an outdoor heat dissipation state (state indicated by a solid line in FIG. 1). In the refrigerant circuit 6, a low-pressure gas refrigerant in a refrigeration cycle is sucked into the compressor 8, is compressed until its pressure becomes a high pressure in the refrigeration cycle, and is then discharged. The high-pressure gas refrigerant discharged from the compressor 8 is sent to the outdoor heat exchanger 11 via the four-way switching valve 10. In the outdoor heat exchanger 11 functioning as a condenser for the refrigerant or a heat dissipater for the refrigerant, at the time of the cooling operation, the high-pressure gas refrigerant that has been sent to the outdoor heat exchanger 11 exchanges heat with outdoor air that is supplied as a cooling source by the outdoor fan 15, dissipates heat (at the time of the defrost operation, dissipates heat while melting frost though the outdoor fan 15 is stopped), and thus becomes a high-pressure liquid refrigerant. The high-pressure liquid refrigerant from which heat has been dissipated in the outdoor heat exchanger 11 is sent to the indoor expansion valves 91*a* and 91*b* via the outdoor expansion valve 12, the liquid-side shutoff valve 13, and the liquid-refrigerant connection pipe 4. The refrigerant that has been sent to the indoor expansion valves 91*a* and 91*b* is depressurized to a low pressure in the refrigeration cycle by the indoor expansion valves 91*a* and 91*b* and becomes a gas-liquid two-phase state refrigerant having a low pressure. The gas-liquid two-phase state refrigerant having a low pressure as a result of the depressurization at the indoor expansion valves 91*a* and 91*b* is sent to the indoor heat exchangers 92*a* and 92*b*. In the indoor heat exchangers 92*a* and 92*b*, at the time of the cooling operation, the gas-liquid two-phase state refrigerant having a low pressure that has been sent to the indoor heat exchangers 92*a* and 92*b* exchanges heat with indoor air that is supplied as a heating source by the indoor fans 93*a* and 93*b*, and evaporates (at the time of the defrost operation, evaporates by exchanging heat with indoor air though driving of the indoor fans 93*a* and 93*b* is stopped). Therefore, the indoor air is cooled, and is then supplied to the inside to cool the inside (or melt the frost on the outdoor heat exchanger 11). The low-pressure gas refrigerant evaporated in the indoor heat exchangers 92*a* and 92*b* is sucked into the compressor 8 again via the gas-refrigerant connection pipe 5, the gas-side shutoff valve 14, the four-way switching valve 10, and the accumulator 7.

At the time of the heating operation, the four-way switching valve 10 is switched to an outdoor evaporation state (state denoted by a broken line in FIG. 1). In the refrigerant circuit 6, a low-pressure gas refrigerant in a refrigeration cycle is sucked into the compressor 8, is compressed until its pressure becomes a high pressure in the refrigeration cycle, and is then discharged. The high-pressure gas refrigerant discharged from the compressor 8 is sent to the indoor heat exchangers 92*a* and 92*b* via the four-way switching valve 10, the gas-side shutoff valve 14, and the gas-refrigerant connection pipe 5. In the indoor heat exchangers 92*a* and 92*b*, the high-pressure gas refrigerant that has been sent to the indoor heat exchangers 92*a* and 92*b* exchanges heat with indoor air that is supplied as a cooling source by the indoor fans 93*a* and 93*b*, dissipates heat, and thus becomes a high-pressure liquid refrigerant. Therefore, the indoor air is heated and is then supplied to the inside to heat the inside. The high-pressure liquid refrigerant from which heat has been dissipated at the indoor heat exchangers 92*a* and 92*b* is sent to the outdoor expansion valve 12 via the indoor expansion valves 91*a* and 91*b*, the liquid-refrigerant connection pipe 4, and the liquid-side shutoff valve 13. The refrigerant that has been sent to the outdoor expansion valve 12 is depressurized to a low pressure in the refrigeration cycle by the outdoor expansion valve 12 and becomes a gas-liquid two-phase state refrigerant having a low pressure. The gas-liquid two-phase state refrigerant having a low pressure as a result of the depressurization at the outdoor expansion valve 12 is sent to the outdoor heat exchanger 11. In the outdoor heat exchanger 11 functioning as an evaporator for the refrigerant, the gas-liquid two-phase state refrigerant having a low pressure sent to the outdoor heat exchanger 11 exchanges heat with outdoor air that is supplied as a heating source by the outdoor fan 15, evaporates, and thus becomes a low-pressure gas refrigerant. The low-pressure refrigerant evaporated in the outdoor heat exchanger 11 is sucked into the compressor 8 again via the four-way switching valve 10 and the accumulator 7.

Though not limited, the cooling operation and the heating operation are started due to an input operation by a user via a remote controller (not shown), and the defrost operation is started when a predetermined defrost start condition is met during the heating operation. The predetermined defrost start condition is not limited. For example, the predetermined defrost start condition may be when the outdoor temperature that is detected by an outdoor temperature sensor (not shown) and/or the temperature of the outdoor heat exchanger 11 that is detected by an outdoor heat-exchange temperature sensor satisfies a predetermined temperature condition.

(3) Structure of Outdoor Heat Exchanger

Figure 2:
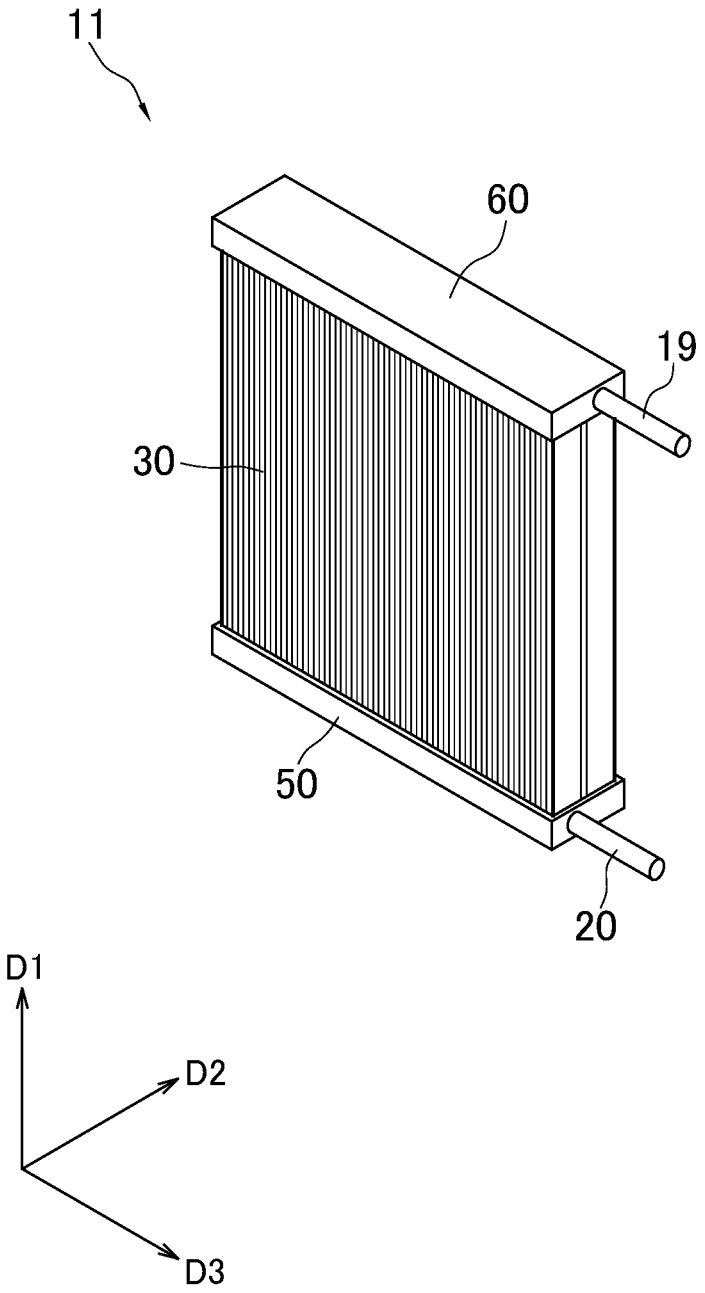
FIG. 2 is an external perspective view of an outdoor heat exchanger.
Figure 3:
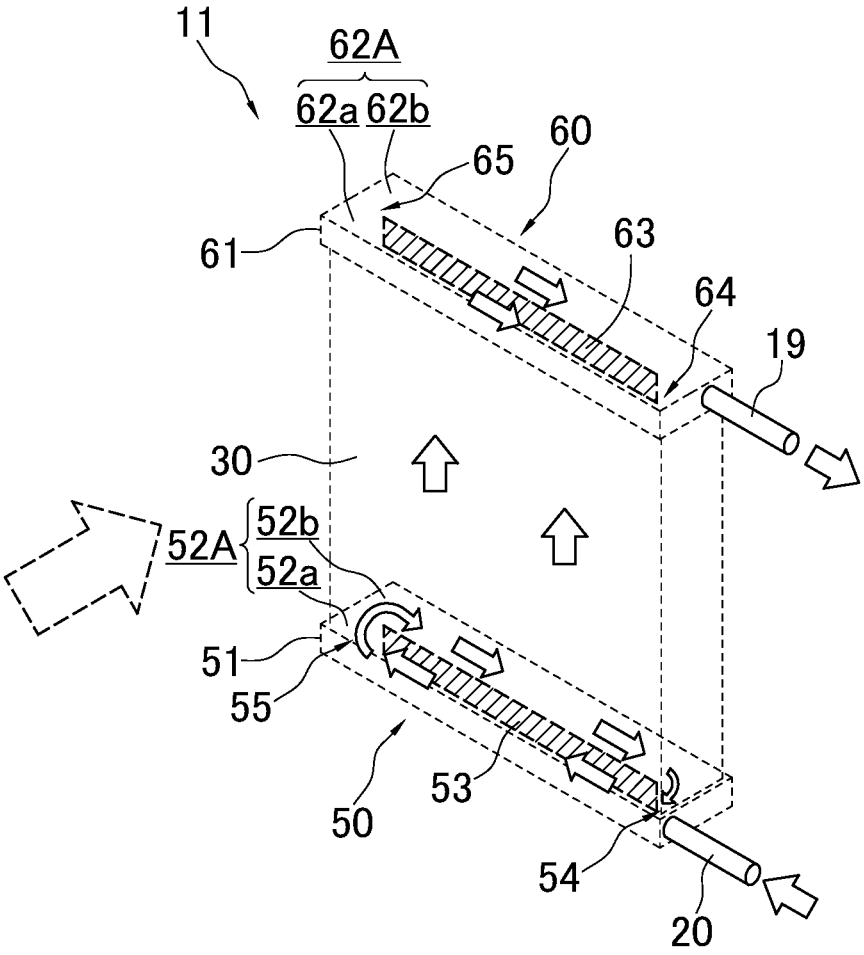
FIG. 3 is an explanatory view illustrating flow of the refrigerant in the outdoor heat exchanger serving as an evaporator.
Figure 4:
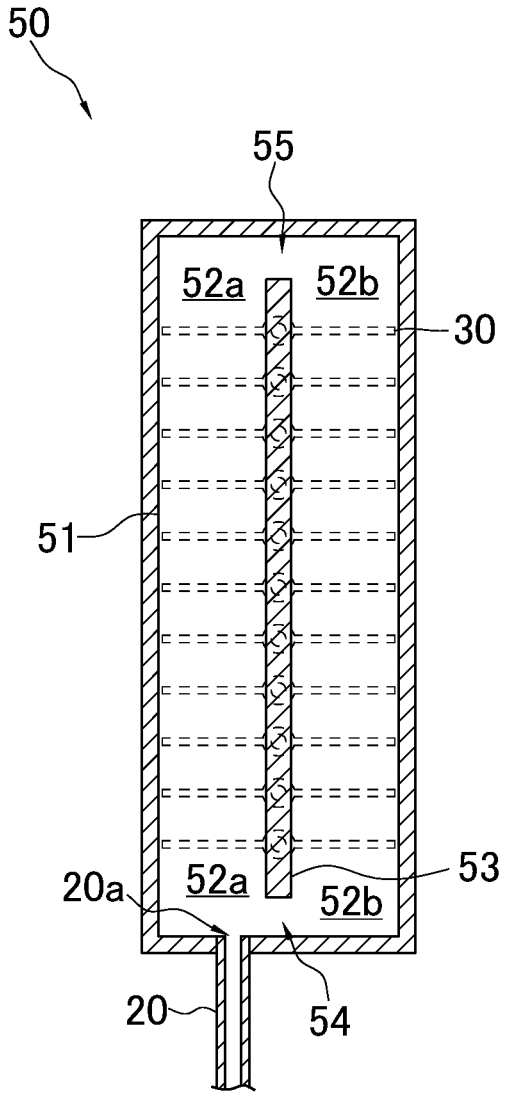
FIG. 4 is a schematic structural plan view of a lower header.
Figure 5:
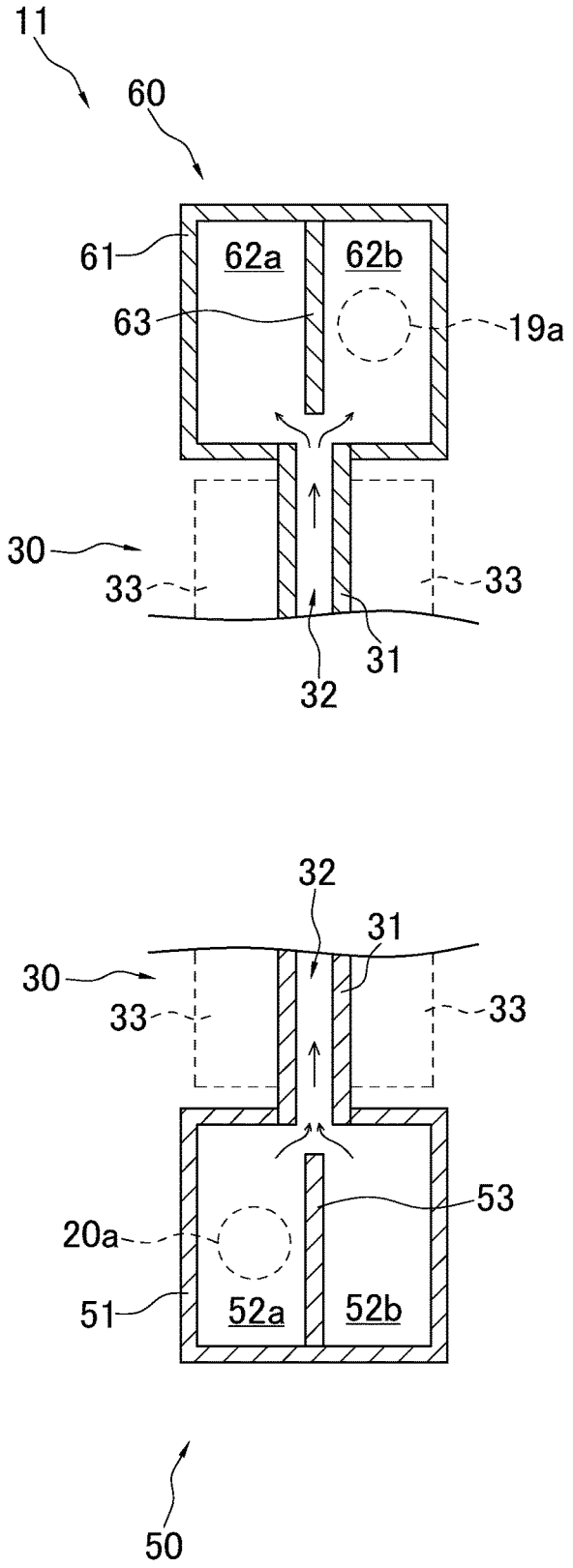
FIG. 5 is a schematic sectional view of an upper header and the lower header when viewed in a longitudinal direction thereof.

FIG. 2 is an external perspective view of the outdoor heat exchanger 11. FIG. 3 is an explanatory view illustrating flow of the refrigerant in the outdoor heat exchanger 11 serving as an evaporator. FIG. 4 is a schematic structural plan view of a lower header 50. FIG. 5 is a schematic sectional view of an upper header 60 and the lower header 50 when viewed in a longitudinal direction thereof.

Note that in the description below, unless otherwise indicated, the direction indicated by arrow D1 in FIG. 2 is an upward direction and an opposite direction thereto is a downward direction; the direction indicated by arrow D2 is a backward direction and an opposite direction thereto is a forward direction; and the direction indicated by arrow D3 is a rightward direction and an opposite direction thereto is a leftward direction.

Note that as indicated by a dotted arrow in FIG. 3, a flow of air that is generated by driving the outdoor fan 15 passes the outdoor heat exchanger 11 towards the back from the front (in the direction of arrow D2 in FIG. 2).

The outdoor heat exchanger 11 is a heat exchanger that causes the refrigerant and outdoor air to exchange heat, and primarily includes the lower header 50, the upper header 60, and fin-tube integrated members 30. Note that members constituting the outdoor heat exchanger 11 are made of aluminum or an aluminum alloy, and are joined to each other by, for example, brazing.

The lower header 50 includes a lower-header main body 51 and a lower circulation partition plate 53. The lower-header main body 51 is constituted by a substantially parallelepiped housing in which a longitudinal direction is a horizontal direction (more specifically, a left-right direction). A rectangular bottom surface of the lower-header main body 51 extends horizontally, wall portions are provided in a standing manner so as to extend upward from end portions in a front-back direction and a left-right direction, and an upper surface having a shape corresponding to the shape of the bottom surface is provided. The refrigerant pipe 20 is connected to a front portion of a right surface of the lower-header main body 51, and a lower connecting port 20*a* is formed. In the vicinity of the lower connecting port 20*a*, the refrigerant pipe 20 extends in a longitudinal direction of a lower inflow space 52*a* of the lower header 50. The plurality of fin-tube integrated members 30 are connected to the upper surface of the lower-header main body 51. The lower circulation partition plate 53 is provided in the lower-header main body 51, and an internal space 52A of the lower-header main body 51 is divided into a front lower inflow space 52*a*, where the lower connecting port 20*a* is formed, and a back lower return space 52*b* (note that the names of the lower inflow space 52*a* and the lower return space 52*b* are based on a flow of the refrigerant when the outdoor heat exchanger 11 functions as an evaporator). The lower circulation partition plate 53 extends upward from the bottom surface of the lower-header main body 51 and extends below the upper surface of the lower-header main body 51. That is, a gap is formed in an up-down direction between the lower circulation partition plate 53 and the upper surface of the lower-header main body 51. A left end portion of the lower circulation partition plate 53 extends up to a location in front of a left surface of the lower-header main body 51, and a lower turn-around opening 55 that connects the lower inflow space 52*a* and the lower return space 52*b* to each other in the front-back direction is provided between the left end portion of the lower circulation partition plate 53 and the left surface of the lower-header main body 51. Similarly, a right end portion of the lower circulation partition plate 53 extends up to a location in front of the right surface of the lower-header main body 51, and a lower return opening 54 that connects the lower inflow space 52*a* and the lower return space 52*b* to each other in the front-back direction is provided between the right end portion of the lower circulation partition plate 53 and the right surface of the lower-header main body 51.

The upper header 60 includes an upper-header main body 61 and an upper circulation partition plate 63, and is positioned directly above the lower header 50 via the plurality of fin-tube integrated members 30. The upper-header main body 61 is constituted by a substantially parallelepiped housing in which a longitudinal direction is a horizontal direction (more specifically, a left-right direction). A rectangular upper surface of the upper-header main body 61 extends horizontally, wall portions are provided in a standing manner so as to extend downward, and a bottom surface having a shape corresponding to the shape of the upper surface is provided. A refrigerant pipe 19 is connected to a back portion of a right surface of the upper-header main body 61, and an upper connecting port 19*a* is formed. The plurality of fin-tube integrated members 30 are connected to the bottom surface of the upper-header main body 61. The upper circulation partition plate 63 is provided in the upper-header main body 61, and an internal space 62A of the upper-header main body 61 is divided into a back upper inflow space 62*b*, where the upper connecting port 19*a* is formed, and a front upper return space 62*a* (note that the names of the upper inflow space 62*b* and the upper return space 62*a* are based on a flow of the refrigerant when the outdoor heat exchanger 11 functions as a condenser). The upper circulation partition plate 63 extends downward from the upper surface of the upper-header main body 61 and extends above the bottom surface of the upper-header main body 61. That is, a gap is formed in the up-down direction between the upper circulation partition plate 63 and the bottom surface of the upper-header main body 61. A left end portion of the upper circulation partition plate 63 extends up to a location in front of a left surface of the upper-header main body 61, and an upper turn-around opening 65 that connects the upper inflow space 62*b* and the upper return space 62*a* to each other in the front-back direction is provided between the left end portion of the upper circulation partition plate 63 and the left surface of the upper-header main body 61. Similarly, a right end portion of the upper circulation partition plate 63 extends up to a location in front of the right surface of the upper-header main body 61, and an upper return opening 64 that connects the upper inflow space 62*b* and the upper return space 62*a* to each other in the front-back direction is provided between the right end portion of the upper circulation partition plate 63 and the right surface of the upper-header main body 61.

Figure 6:
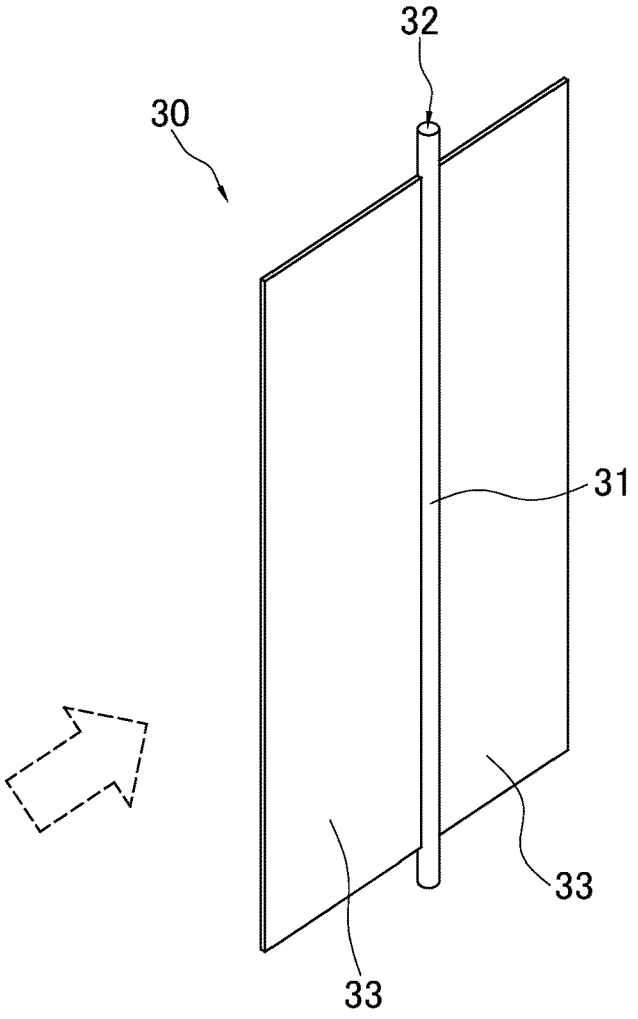
FIG. 6 is a schematic external perspective view of a fin-tube integrated member.
Figure 7:
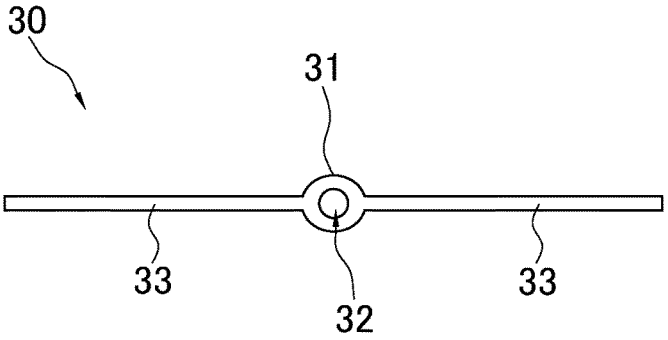
FIG. 7 is a schematic structural view of the fin-tube integrated member when viewed in a cross section of a flow path.

As shown in the schematic external perspective view of FIG. 6 and the schematic plan view of FIG. 7, a fin-tube integrated member 30 includes a heat transfer tube 31 and a fin 33 that are integrated with each other. The heat transfer tube 31 has a circular cylindrical shape extending in the up-down direction, and a flow path 32 is formed in the heat transfer tube 31. The fin 33 extends in the front-back direction and the up-down direction so as to extend in both the upward direction and the downward direction (both upstream and downstream sides in a direction of air flow) with respect to the heat transfer tube 31. A lower end of the heat transfer tube 31 extends further below a lower end of the fin 33 and is connected to a vicinity of the center in the front-back direction of the upper surface of the lower-header main body 51. An upper end of the heat transfer tube 31 extends further above an upper end of the fin 33 and is connected to a vicinity of the center in the front-back direction of the bottom surface of the upper-header main body 61. Note that when viewed from the upper surface, each heat transfer tube 31 is disposed so as to overlap the lower circulation partition plate 53 of the lower header 50 and the upper circulation partition plate 63 of the upper header 60. Here, a lower end of each heat transfer tube 31 extends up to a location in front of an upper end of the lower circulation partition plate 53 of the lower header 50, and the lower end of each heat transfer tube 31 and the upper end of the lower circulation partition plate 53 are not in contact with each other. Therefore, the lower end of each heat transfer tube 31 is in a state of communication with each of the lower inflow space 52*a* and the lower return space 52*b* in the lower header 50. Similarly, the upper end of each heat transfer tube 31 extends up to a location in front of a lower end of the upper circulation partition plate 63 of the upper header 60, and the upper end of each heat transfer tube 31 and the lower end of the upper circulation partition plate 63 are not in contact with each other. The upper end of each heat transfer tube 31 is in a state of communication with each of the upper inflow space 62*b* and the upper return space 62*a* in the upper header 60.

Figure 8:
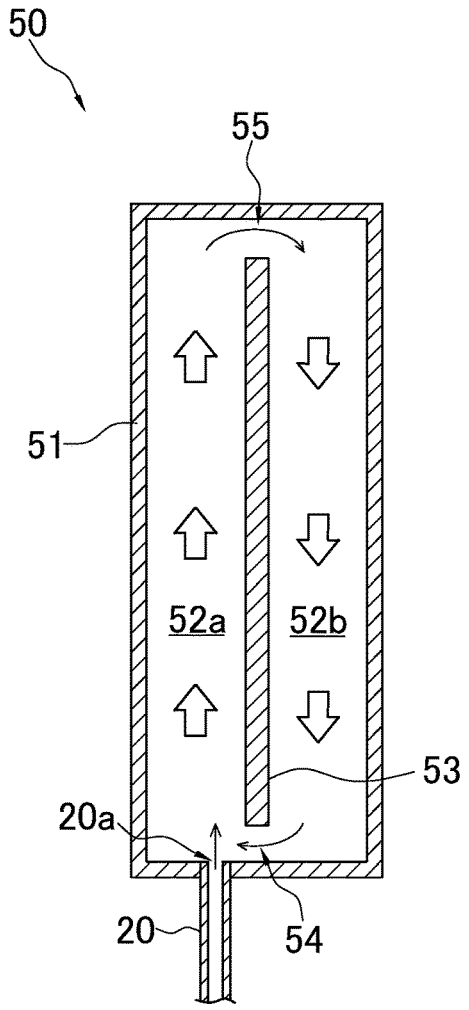
FIG. 8 is a schematic plan view illustrating flow of the refrigerant in the lower header.

(4) Flow of Refrigerant when Outdoor Heat Exchanger 11 Functions as Evaporator for Refrigerant When the outdoor heat exchanger 11 functions as an evaporator for the refrigerant (when a heating operation is performed in the air conditioner 1), after the refrigerant has been condensed in the indoor heat exchangers 92*a* and 92*b* and has passed through the liquid-refrigerant connection pipe 4, the refrigerant in a gas-liquid two-phase refrigerant state flows in the refrigerant pipe 20 and flows into the outdoor heat exchanger 11. Here, as indicated in FIG. 2 and by solid arrows in FIG. 8, the refrigerant that has flowed into the lower header 50 from the lower connecting port 20*a* via the refrigerant pipe 20 flows in the lower inflow space 52*a* towards a side opposite to the lower connecting port 20*a* (toward the left) while the refrigerant is divided by and flows into each heat transfer tube 31, passes through the lower turn-around opening 55, flows into the lower return space 52*b*, and flows toward the lower connecting port 20*a* (toward the right) while the refrigerant that has reached the lower return space 52*b* is divided by and flows into each heat transfer tube 31. Then, the refrigerant that has reached the lower return port opening 54 flows again in the lower inflow space 52*a* toward a side opposite to the lower connecting port 20*a* (toward the left). In this way, in the lower header 50, the refrigerant circulates while the refrigerant is divided by and flows into each heat transfer tube 31.

The refrigerant that has flowed upward in each heat transfer tube 31 and that has reached the upper header 60 flows toward the upper connecting port 19*a* (toward the right) in each of the upper return space 62*a* and the upper inflow space 62*b*, and flows out of the outdoor heat exchanger 11 via the refrigerant pipe 19.

Note that when the outdoor heat exchanger 11 functions as a condenser for the refrigerant, the flow of the refrigerant is opposite to the flow of the refrigerant described above. After the refrigerant has circulated in the upper header 60 and has flowed downward in each heat transfer tube 31, the refrigerant flows toward the lower connecting port 20*a* (toward the right) in each of the lower inflow space 52*a* and the lower return space 52*b* of the lower header 50, and flows out of the outdoor heat exchanger 11 via the refrigerant pipe 20.

(5) Features (5-1)

In the outdoor heat exchanger 11 according to one or more embodiments, when the outdoor heat exchanger 11 functions as an evaporator and when the refrigerant that has flowed into the lower header 50 via the lower connecting port 20*a* is caused to be divided by and to flow into the plurality of heat transfer tubes 31, the refrigerant circulates into the lower inflow space 52*a*, the lower turn-around opening 55, the lower return space 52*b*, and the lower return opening 54 in this order. During the circulation, the refrigerant circulating in the lower header 50 whose longitudinal direction is a horizontal direction and whose bottom surface extends horizontally moves in the horizontal direction and does not move against its own weight upward in a vertical direction. In this way, in the lower header 50, since the refrigerant can be circulated without being affected by its own weight, the likelihood of the refrigerant stagnating in the lower inflow space 52*a*, the lower turn-around opening 55, the lower return space 52*b*, and the lower return opening 54 of the lower header 50 is decreased.

In addition, in this way, since the refrigerant flowing in both the lower inflow space 52*a* and the lower return space 52*b* with the stagnation being suppressed can be sent to the plurality of heat transfer tubes 31 that are positioned in the longitudinal direction of the lower header 50, it is possible to equally distribute the refrigerant.

Even if there is a deviation in the distribution of the liquid refrigerant in the longitudinal direction of the lower header 50 in each of the lower inflow space 52*a* and the lower return space 52*b*, when the relationship between the manner of distribution of the liquid refrigerant in the longitudinal direction of the lower header 50 in the lower inflow space 52*a* and the manner of distribution of the liquid refrigerant in the longitudinal direction of the lower header 50 in the lower return space 52*b* are opposite to each other, the refrigerant flows, with the deviations of the distributions of the liquid refrigerants in the longitudinal direction of the lower header 50 slightly canceling each other out, in each of the heat transfer tubes 31 in which the refrigerants from the lower inflow space 52*a* and the lower return space 52*b* merge and flow. Therefore, even if the liquid refrigerant in the lower inflow space 52*a* or the lower return space 52*b* is unevenly distributed, there exists a case in which drift of the refrigerant flowing in each heat transfer tube 31 can be suppressed.

In the outdoor heat exchanger 11, an end portion of the flow path 32 of each heat transfer tube 31 is connected directly to both the lower inflow space 52*a* and the lower return space 52*b*. Therefore, the refrigerant that flows into a heat transfer tube 31 from the lower inflow space 52*a* and the refrigerant that flows into the same heat transfer tube 31 from the lower return space 52*b* are mixed while passing through the flow path of this heat transfer tube 31. Consequently, the refrigerant that passes through this heat transfer tube 31 is capable of sufficiently exchanging heat with air around the outdoor heat exchanger 11.

The refrigerant pipe 20 is connected to the lower inflow space 52*a* of the lower header 50 via the lower connecting port 20*a*, and, in the vicinity of the lower connecting port 20*a*, the refrigerant pipe 20 extends in the longitudinal direction of the lower inflow space 52*a* of the lower header 50. Therefore, by utilizing the force of the flow of the refrigerant passing the vicinity of the lower connecting port 20*a* of the refrigerant pipe 20, it is possible to sufficiently circulate the refrigerant in the lower header 50. Moreover, since the refrigerant flowing into the lower header 50 via the refrigerant pipe 20 passes through the lower inflow space 52*a* whose width is narrower than an internal space of the lower header 50 by providing the lower circulation partition plate 53, it is possible to suppress reduction in the flow speed of the refrigerant flowing in the lower inflow space 52*a*. Therefore, it can be easier to circulate the refrigerant.

Since, the lower end of each heat transfer tube 31 that is connected to the lower header 50 is positioned above an upper end of the lower circulation partition plate 53, it can be made easier to circulate the refrigerant without interfering with the flow of the refrigerant circulating in the lower inflow space 52*a* and the lower return space 52*b*.

(5-2)

The outdoor heat exchanger 11 according to one or more embodiments uses the fin-tube integrated members 30 each including a heat transfer tube 31 and a fin 33, the fin 33 extending in the direction of air flow (front-back direction) and in the up-down direction and the heat transfer tube 31 extending in the up-down direction. Therefore, when a defrost operation has been performed to melt frost that has adhered to a surface of the outdoor heat exchanger 11 due to the outdoor heat exchanger 11 functioning as an evaporator for the refrigerant at the time of a heating operation, the melted frost tends to fall. For example, compared with an outdoor heat exchanger of a type that is constituted by heat transfer tubes that are flat tubes extending in the horizontal direction, it is easy to cause the frost to fall.

(6) Modifications (6-1) Modification A

In the embodiments above, fin-tube integrated members 30 in which one heat transfer tube 31 has only one circular cylindrical flow path 32 are taken as examples.

Figure 9:
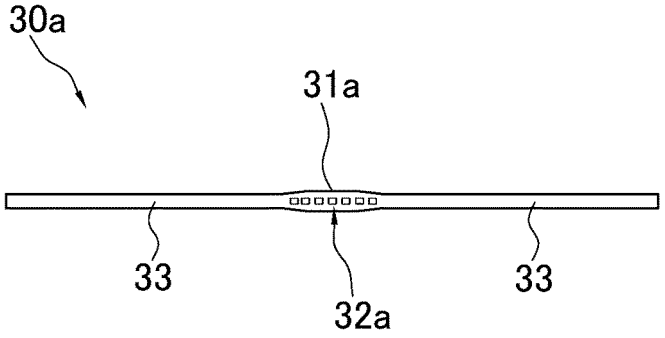
FIG. 9 is a schematic structural of a fin-tube integrated member according to Modification A when viewed in a cross section of a flow path.

However, the heat transfer tubes are not limited to those having only one flow path 32. For example, as shown in FIG. 9, the heat transfer tubes may be flat porous tubes 31*a* having a plurality of flow paths 32*a* disposed side by side in the front-back direction (direction of air flow). Even in fin-tube integrated members 30*a* of this case, fins 33 can be formed so as to extend in the up-down direction forwardly of and backwardly of the flat porous tubes 31*a* (upstream side and downstream side in the direction of air flow). The plurality of flow paths 32*a* may include flow paths 32*a* that as a whole are positioned directly above the lower inflow space 52*a* and flow paths 32*a* that as a whole are positioned directly above the lower return space 52*b*.

The structure including such flow paths 32*a* that are provided side by side in the direction of air flow makes it possible to ensure in the direction of air flow a wide portion that is near the flow paths 32*a* and that easily transfers heat.

(6-2) Modification B

In the embodiments above, the outdoor heat exchanger 11 in which the bottom surface of the lower header 50 and the bottom surface of the upper header 60 extend horizontally and in which the lower circulation partition plate 53 and the heat transfer tubes 31 extend vertically is taken as an example and described.

Figure 10:
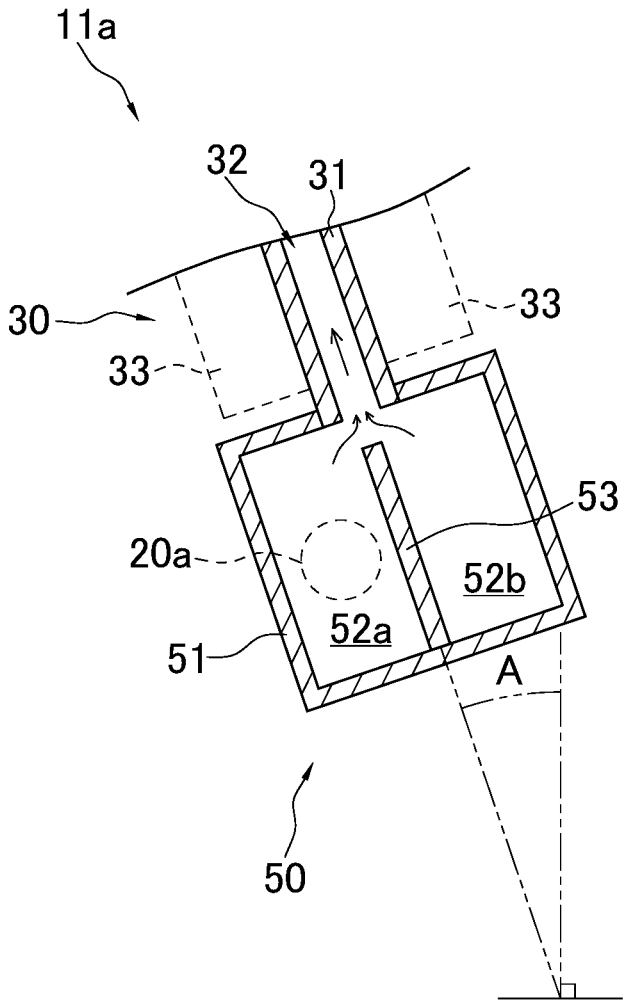
FIG. 10 is a schematic sectional view of a vicinity of a lower header according to Modification B when viewed in a longitudinal direction of the lower header.

However, for example, as shown in FIG. 10, the outdoor heat exchanger may be an outdoor heat exchanger 11*a* in which, when viewed in the longitudinal direction of the lower header 50, the bottom surface of the lower header 50 and the bottom surface of the upper header 60 extend as tilted surfaces tilted from the horizontal, and the lower circulation partition plate 53 and the heat transfer tubes 31 are used in an orientation in which they extend so as to be tilted with a tilt angle A from the vertical direction.

When the outdoor heat exchanger 11*a* is used in a tilted orientation in this way, a lower end of the lower inflow space 52*a*, at which the lower connecting port 20*a* is provided, may be oriented so as to be positioned below a lower end of the lower return space 52*b* from the viewpoint of making it easy to bring the refrigerant in a circulating state. That is, in the lower inflow space 52*a*, at which the lower connecting port 20*a* is provided, since the refrigerant flows with greater momentum than in the lower return space 52*b*, even if the refrigerant is slightly opposing its own weight, it is possible to cause the refrigerant to flow in the lower turn-around opening 55 towards the side of the lower return space 52*b* from the side of the lower inflow space 52*a* and to make it easier to cause the refrigerant to circulate in the lower header 50.

The tilt angle A at which the lower circulation partition plate 53 and the heat transfer tubes 31 are tilted from the vertical direction may be less than or equal to 45 degrees or may be less than or equal to 30 degrees.

(6-3) Modification C

In the outdoor heat exchanger 11*a* according to Modification B above, the case in which the lower header 50, the upper header 60, the lower circulation partition plate 53, and the heat transfer tubes 31 are all in a tilted orientation compared with the embodiments above is taken as an example and described.

Figure 11:
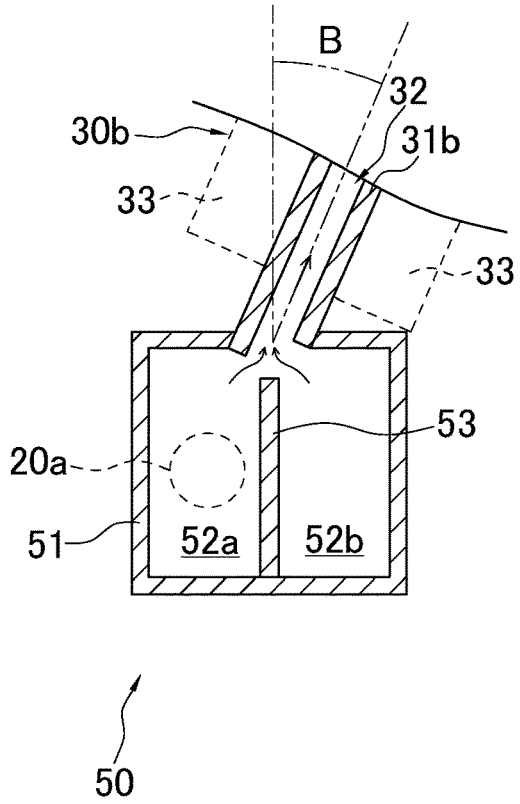
FIG. 11 is a schematic sectional view of a vicinity of a lower header according to Modification C when viewed in a longitudinal direction of the lower header.

In contrast, for example, as shown in FIG. 11, the bottom surface of the lower header 50 and the bottom surface of the upper header 60 may each extend horizontally as in the embodiments above, the lower circulation partition plate 53 may also extend in the vertical direction as in the embodiments above, and fin-tube integrated members 30*b* including heat transfer tubes 31*b* may be tilted at a tilt angle B. The tilt angle B in this case may be less than or equal to 45 degrees or may be less than or equal to 30 degrees. By suppressing the tilt angle from the vertical direction to a small angle in this way, even if the liquid refrigerant has reached the inlets of the heat transfer tubes, it is possible to suppress the liquid refrigerant from drifting and flowing along a lower portion in the flow paths 32 in the heat transfer tubes 31*b*, and to make uniform the refrigerant distribution at the entire inner peripheral surface of the flow paths 32 in the heat transfer tubes 31*b*.

(6-4) Modification D

In the embodiments above, the case in which the flow paths 32 of the heat transfer tubes 31 of the fin-tube integrated members 30 communicate with both the lower inflow space 52*a* and the lower return space 52*b* of the lower header 50 is taken as an example and described.

Figure 12:
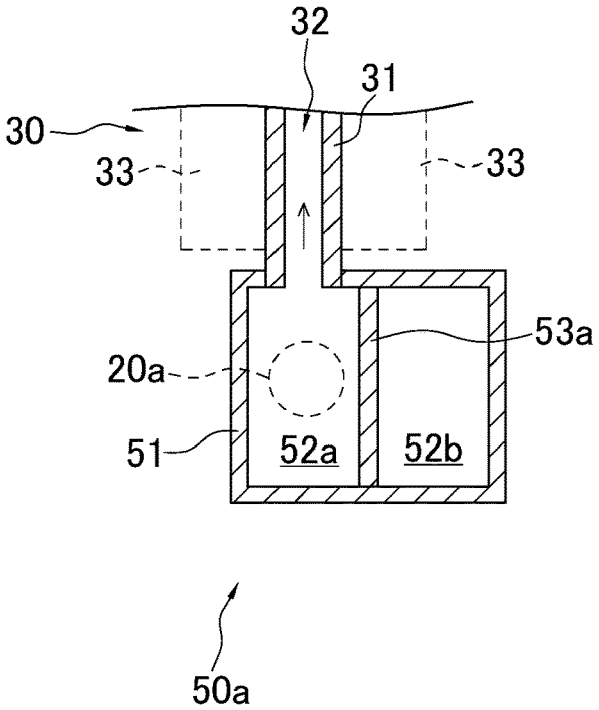
FIG. 12 is a schematic sectional view of a vicinity of a lower header according to Modification D when viewed in a longitudinal direction of the lower header.

In contrast, for example, as in a lower header 50*a* shown in FIG. 12, a structure in which the flow paths 32 of the heat transfer tubes 31 of the fin-tube integrated members 30 directly communicate with only the lower inflow space 52*a* and do not communicate with the lower return space 52*b* may be used.

According to this structure, since the lower inflow space 52*a* to which the flow paths 32 of the heat transfer tubes 31 are connected is a space in which the lower connecting port 20*a* is formed and into which the refrigerant flows first when the outdoor heat exchanger 11 functions as an evaporator for the refrigerant, the refrigerant easily passes the space at a sufficient flow speed. In particular, since the internal space of the lower header 50 is divided by the lower circulation partition plate 53, the refrigerant passage area of the lower inflow space 52*a* can be made smaller than the internal space of the lower header 50 when viewed in the longitudinal direction. Therefore, it is possible to suppress reduction in the flow speed of the refrigerant flowing in the lower inflow space 52*a*. Therefore, even in an environment in which the circulation amount of the refrigerant is relatively small, the refrigerant that has flowed into the lower inflow space 52*a* from the lower connecting port 20*a* can reach not only the heat transfer tubes 31 that are connected to the vicinity of the lower connecting port 20*a* but also the heat transfer tubes 31 that are connected at positions situated away from the lower connecting port 20*a* of the lower inflow space 52*a*. Consequently, it is possible to suppress to a small amount drift of the refrigerant in the plurality of heat transfer tubes 31 that are provided side by side in the longitudinal direction of the lower header 50.

(6-5) Modification E

Figure 13:
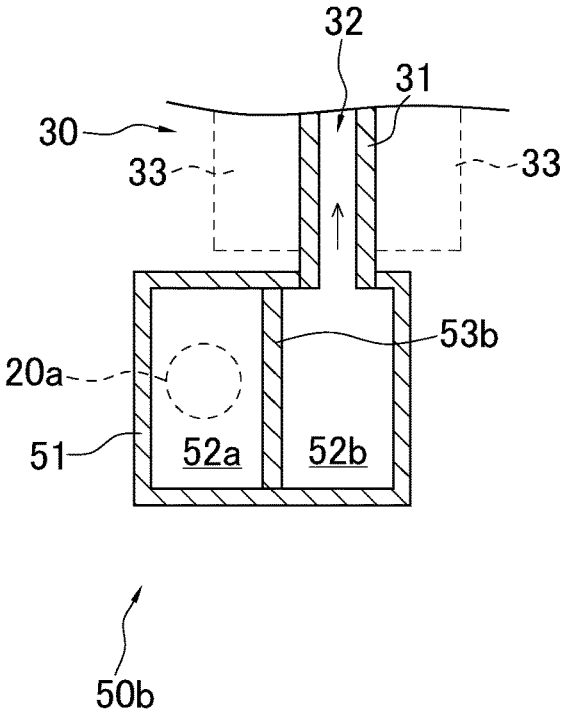
FIG. 13 is a schematic sectional view of a vicinity of a lower header according to Modification E when viewed in a longitudinal direction of the lower header.

For example, as in a lower header 50*b* shown in FIG. 13, a structure in which the flow paths 32 of the heat transfer tubes 31 of the fin-tube integrated members 30 directly communicate with only the lower return space 52*b* and do not communicate with the lower inflow space 52*a* may be used.

According to this structure, in an environment in which the circulation amount of the refrigerant is relatively large when the outdoor heat exchanger 11 functions as an evaporator for the refrigerant, even if the refrigerant passes the vicinity of the lower connecting port 20*a* at a relatively high flow speed, since the heat transfer tubes are not connected to the lower inflow space 52*a*, it is possible to suppress the existence of heat transfer tubes 31 to which the refrigerant is less likely to be supplied due to the refrigerant passing the heat transfer tubes 31 quickly without flowing into the heat transfer tubes 31 as a result of the flow speed of the refrigerant being too high. Even if the refrigerant passes the lower inflow space 52*a* at a relatively high flow speed, the liquid refrigerant that has reached a place situated away from the lower connecting port 20*a* has its flow speed reduced to a more proper flow speed via the lower turn-around opening 55, and is supplied to the lower return space 52*b*. Therefore, in the lower return space 52*b*, it is possible to cause the refrigerant, with its flow speed being reduced to a proper flow speed, to be properly divided by and to properly flow to each heat transfer tube 31.

(6-6) Modification F

In Modification D above, the lower header 50*a* in which the flow paths 32 of the heat transfer tubes 31 of the fin-tube integrated members 30 are directly connected to only the lower inflow space 52*a* and are not connected to the lower return space 52*b* is taken as an example and described.

Figure 14:
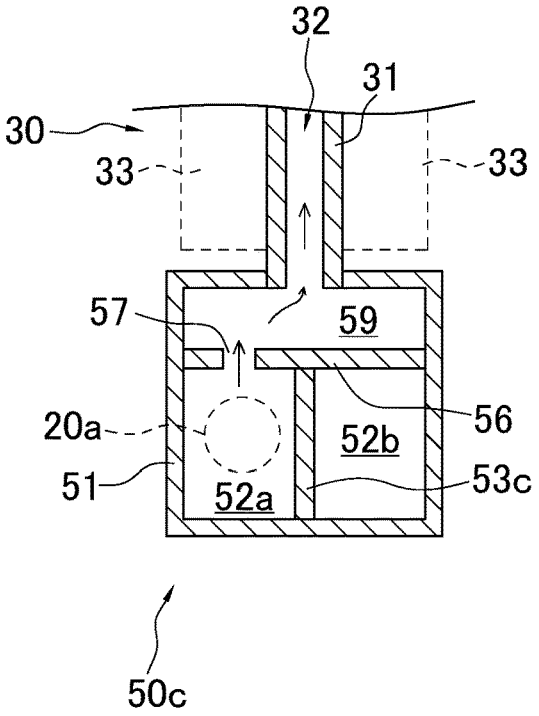
FIG. 14 is a schematic sectional view of a vicinity of a lower header according to Modification F when viewed in a longitudinal direction of the lower header.

In contrast, for example, as in a lower header 50*c* shown in FIG. 14, a stirring chamber 59 may be interposed between a lower end of the flow path 32 of each heat transfer tube 31 and the lower inflow space 52*a* of the lower header 50*c*. Here, in the lower header 50*c*, the lower inflow space 52*a* and the lower return space 52*b* that are disposed on a lower side are separated from the stirring chamber 59 that is disposed on an upper side by a stirring partition plate 56 that is a plate-shaped member extending horizontally while in contact with an upper end of a lower circulation partition plate 53*c* in the lower header 50*c*. Although an opening is not provided in a portion of the stirring partition plate 56 facing the lower return space 52*b*, a portion of the stirring partition plate 56 facing the lower inflow space 52*a* has an inflow-side communication port 57 extending therethrough in the up-down direction. The inflow-side communication port 57 is not limited and may be constituted by a plurality of openings provided so as to be disposed side by side in the longitudinal direction of the lower header 50*c* or may be formed by one opening extending in the longitudinal direction of the lower header 50*c*.

According to the structure above, before the refrigerant that has flowed into the stirring chamber 59 via the inflow-side communication port 57 from the lower inflow space 52*a* is divided by and flows into each heat transfer tube 31, it is possible to stir a gas-phase refrigerant and a liquid-phase refrigerant in the stirring chamber 59. Therefore, it is possible to further effectively suppress drift of the refrigerant flowing in each heat transfer tube 31. Moreover, here, it is possible to effectively obtain the effects described in Modification D.

(6-7) Modification G

In Modification E above, the lower header 50*b* in which the flow paths 32 of the heat transfer tubes 31 of the fin-tube integrated members 30 are directly connected to only the lower return space 52*b* and are not connected to the lower inflow space 52*a* is taken as an example and described.

Figure 15:
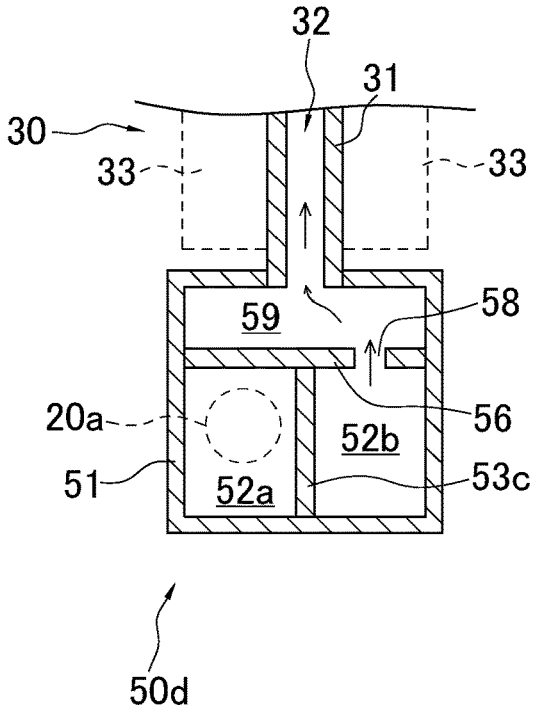
FIG. 15 is a schematic sectional view of a vicinity of a lower header according to Modification G when viewed in a longitudinal direction of the lower header.

In contrast, for example, as in a lower header 50*d* shown in FIG. 15, a stirring chamber 59 may be interposed between the lower end of the flow path 32 of each heat transfer tube 31 and the lower return space 52*b* of the lower header 50*d*. Here, in the lower header 50*d*, the lower inflow space 52*a* and the lower return space 52*b* that are disposed on a lower side are separated from the stirring chamber 59 that is disposed on an upper side by a stirring partition plate 56 that is a plate-shaped member extending horizontally while in contact with an upper end of a lower circulation partition plate 53*c* in the lower header 50*d*. Although an opening is not provided in a portion of the stirring partition plate 56 facing the lower inflow space 52*a*, a portion of the stirring partition plate 56 facing the lower return space 52*b* has a return-side communication port 58 extending therethrough in the up-down direction. The return-side communication port 58 is not limited and may be constituted by a plurality of openings provided so as to be disposed side by side in the longitudinal direction of the lower header 50*d* or may be constituted by one opening extending in the longitudinal direction of the lower header 50*d*.

According to the structure above, before the refrigerant that has flowed into the stirring chamber 59 via the return-side communication port 58 from the lower return space 52*b* is divided by and flows into each heat transfer tube 31, it is possible to stir a gas-phase refrigerant and a liquid-phase refrigerant in the stirring chamber 59. Therefore, it is possible to further effectively suppress drift of the refrigerant flowing in each heat transfer tube 31. Moreover, here, it is possible to effectively obtain the effects described in Modification E.

(6-8) Modification H

In the embodiments above, the case in which the flow paths 32 of the heat transfer tubes 31 of the fin-tube integrated members 30 directly communicate with both the lower inflow space 52*a* and the lower return space 52*b* of the lower header 50 is taken as an example and described.

Figure 16:
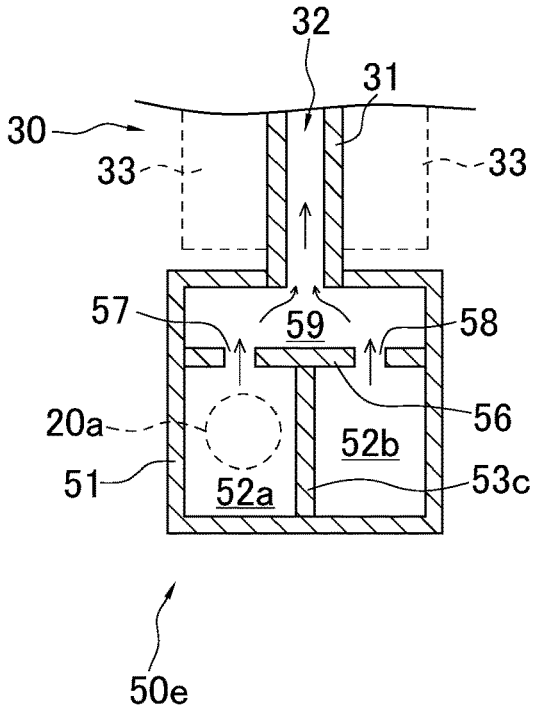
FIG. 16 is a schematic sectional view of a vicinity of a lower header according to Modification H when viewed in a longitudinal direction of the lower header.

In contrast, for example, as in a lower header 50*e* shown in FIG. 16, a stirring chamber 59 may be interposed between the lower end of the flow path 32 of each heat transfer tube 31 and the lower inflow space 52*a* and the lower return space 52*b* of the lower header 50*e*. Here, in the lower header 50*e*, the lower inflow space 52*a* and the lower return space 52*b* that are disposed on a lower side are separated from the stirring chamber 59 that is disposed on an upper side by a stirring partition plate 56 that is a plate-shaped member extending horizontally while in contact with an upper end of a lower circulation partition plate 53*c* in the lower header 50*e*. A portion of the stirring partition plate 56 facing the lower inflow space 52*a* has an inflow-side communication port 57 extending therethrough in the up-down direction, and a portion of the stirring partition plate 56 facing the lower return space 52*b* has a return-side communication port 58 extending therethrough in the up-down direction. The inflow-side communication port 57 and the return-side communication port 58 are not limited and may be constituted by a plurality of openings provided so as to be disposed side by side in the longitudinal direction of the lower header 50*e* or may be constituted by one opening extending in the longitudinal direction of the lower header 50*e*.

According to the structure above, regarding an entire refrigerant that is a combination of the refrigerant that has flowed into the stirring chamber 59 via the inflow-side communication port 57 from the lower inflow space 52*a* and the refrigerant that has flowed into the stirring chamber 59 via the return-side communication port 58 from the lower return space 52*b*, before the entire refrigerant, rather than before only the refrigerant that has flowed into the stirring chamber 59 via the inflow-side communication port 57 from the lower inflow space 52*a*, is divided by and flows into each heat transfer tube 31, it is possible to stir a gas-phase refrigerant and a liquid-phase refrigerant in the stirring chamber 59. Therefore, it is possible to further effectively suppress drift of the refrigerant flowing in each heat transfer tube 31. Moreover, here, it is possible to effectively obtain the effects described in the embodiments above.

(6-9) Modification I

In Modification H above, the case in which fin-tube integrated members 30 each including in the left-right direction (direction of air flow) one heat transfer tube 31 having one flow path 32 are connected to the stirring chamber 59 is taken as an example and described.

Figure 17:
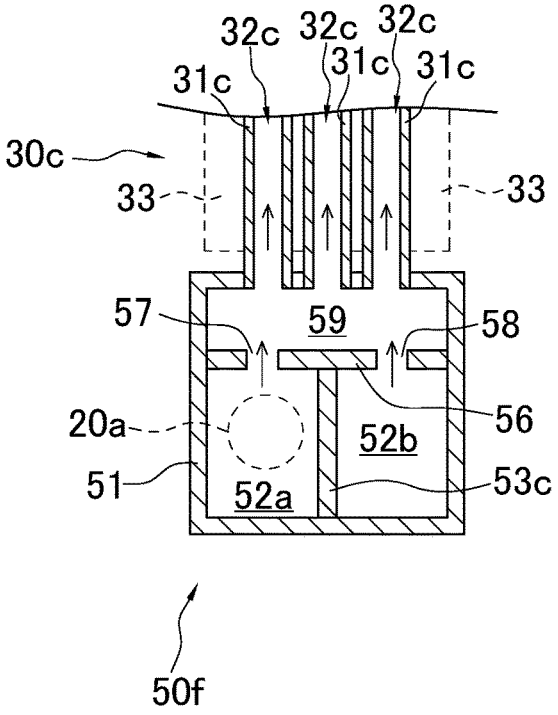
FIG. 17 is a schematic sectional view of a vicinity of a lower header according to Modification I when viewed in a longitudinal direction of the lower header.

In contrast, for example, as shown in a lower header 50*f* shown in FIG. 17, a fin-tube integrated member 30*c* including in the left-right direction (direction of air flow) a plurality of heat transfer tubes 31*c* each having one flow path 32*c* may be connected to a stirring chamber 59. Since the refrigerant after a gas-phase refrigerant and a liquid-phase refrigerant have been sufficiently stirred in the stirring chamber 59 flows in each of these heat transfer tubes 31*c*, the refrigerant therebetween is less likely to drift. Moreover, by providing the plurality of heat transfer tubes 31*c* in the direction of air flow, it is easier to ensure a wide heat transfer area that makes it possible to efficiently exchange heat.

(6-10) Modification J

In Modification D above, the lower header 50*a* in which the flow paths 32 of the heat transfer tubes 31 of the fin-tube integrated members 30 are directly connected to only the lower inflow space 52*a* and are not connected to the lower return space 52*b* is taken as an example and described.

Figure 18:
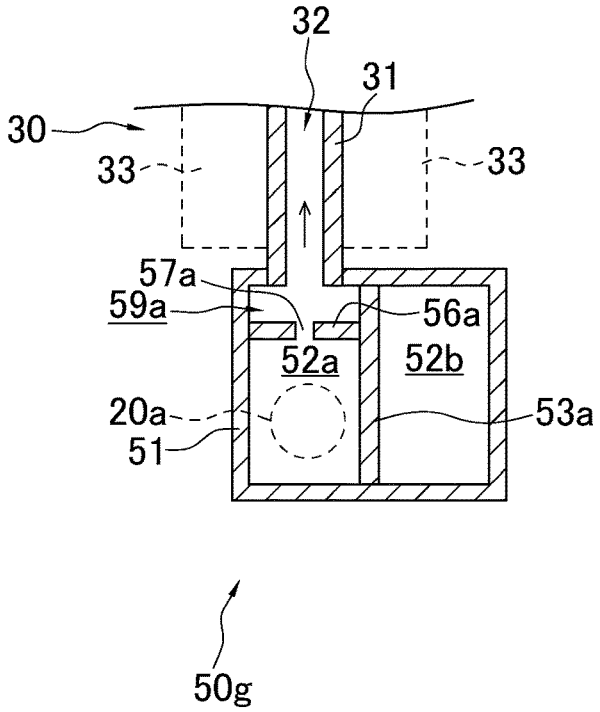
FIG. 18 is a schematic sectional view of a vicinity of a lower header according to Modification J when viewed in a longitudinal direction of the lower header.

In contrast, for example, as in a lower header 50*g* shown in FIG. 18, a stirring chamber 59*a* may be interposed between a lower end of the flow path 32 of each heat transfer tube 31 and the lower inflow space 52*a*. Here, the inside of the lower header 50*g* is divided into a lower inflow space 52*a* and the stirring chamber 59*a* on the left (upstream side in the direction of air flow) and a lower return space 52*b* on the right (downstream side in the direction of air flow) by a lower circulation partition plate 53*a*. The stirring chamber 59*a* and the lower inflow space 52*a* are separated from each other by a stirring partition plate 56*a*, and the stirring chamber 59*a* is positioned above the lower inflow space 52*a* in the vertical direction. The stirring partition plate 56*a* has an inflow-side communication port 57*a* extending therethrough in the up-down direction. The inflow-side communication port 57*a* is not limited and may be constituted by a plurality of openings provided so as to be disposed side by side in the longitudinal direction of the lower header 50*g* or may be constituted by one opening extending in the longitudinal direction of the lower header 50*g*.

Even the structure above provides the effects of the structure of Modification D and drift suppression effects provided by providing the stirring chamber 59*a*.

(6-11) Modification K

In Modification E above, the lower header 50*b* in which the flow paths 32 of the heat transfer tubes 31 of the fin-tube integrated members 30 are directly connected to only the lower return space 52*b* and are not connected to the lower inflow space 52*a* is taken as an example and described.

Figure 19:
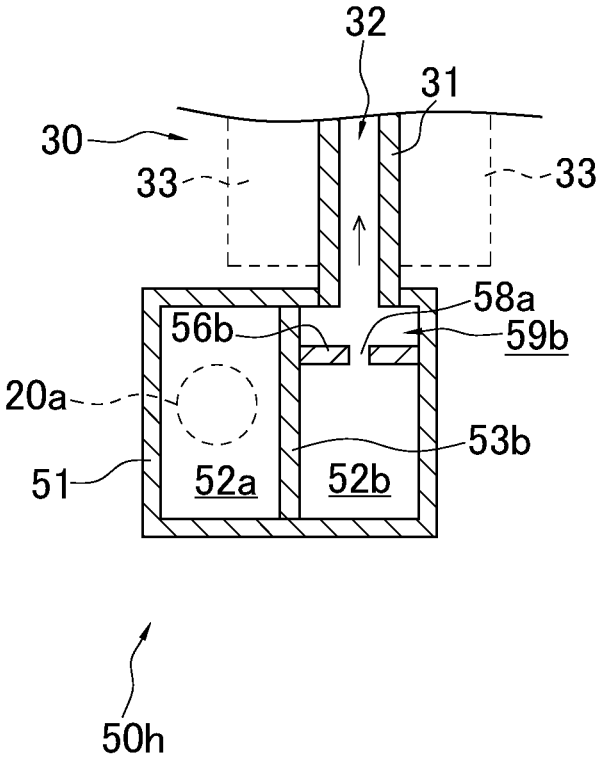
FIG. 19 is a schematic sectional view of a vicinity of a lower header according to Modification K when viewed in a longitudinal direction of the lower header.

In contrast, for example, as in a lower header 50*h* shown in FIG. 19, a stirring chamber 59*b* may be interposed between a lower end of the flow path 32 of each heat transfer tube 31 and the lower return space 52*b*. Here, the inside of the lower header 50*h* is divided into a lower inflow space 52*a* on the left (upstream side in the direction of air flow) and a lower return space 52*b* and the stirring chamber 59*b* on the right (downstream side in the direction of air flow) by a lower circulation partition plate 53*b*. The stirring chamber 59*b* and the lower return space 52*b* are separated from each other by a stirring partition plate 56*b*, and the stirring chamber 59*b* is positioned above the lower return space 52*b* in the vertical direction. The stirring partition plate 56*b* has a return-side communication port 58*a* extending therethrough in the up-down direction. The return-side communication port 58*a* is not limited and may be constituted by a plurality of openings provided so as to be disposed side by side in the longitudinal direction of the lower header 50*h* or may be constituted by one opening extending in the longitudinal direction of the lower header 50*h*.

Even the structure above provides the effects of the structure of Modification E and drift suppression effects provided by providing the stirring chamber 59*b*.

(6-12) Modification L

Although in the embodiments above, the refrigerant pipe 20 is connected as it is to the lower header 50, for example, the refrigerant pipe 20 may be formed in the form of a nozzle by making a refrigerant passage area of the lower connecting port 20*a* smaller than a flow-path area of the refrigerant pipe 20 or by similarly making a refrigerant passage area of the upper connecting port 19*a* smaller than a flow-path area of the refrigerant pipe 19.

(6-13) Modification M

Although in the embodiments above, the case in which the refrigerant pipe 20 is connected to only one end of the lower header 50 in the longitudinal direction is described, pipes that branch off from the refrigerant pipe 20 at a lower-return-space-52*b*-side portion of the other end of the lower header

50 may be connected to cause the refrigerant to flow in from both sides of the lower header 50 in the longitudinal direction and to circulate and flow.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 air conditioner
2 outdoor unit
9 indoor unit
6 refrigerant circuit
11 outdoor heat exchanger (heat exchanger)
15 outdoor fan
19 refrigerant pipe
19*a* upper connecting port (inflow port)
20 refrigerant pipe
20*a* lower connecting port (inflow port)
30 fin-tube integrated member
31 heat transfer tube (circular tube)
31*a~c* flat tube (heat transfer tube)
50 lower header (header)
51 lower header main body
50*a~h* lower header (header)
52*a* lower inflow space (first space)
52*b* lower return space (second space)
53 lower circulation partition plate (circulation member)
53*a~c* lower circulation partition plate (circulation member)
54 lower return opening (second communication port)
55 lower turn-around opening (first communication port)
56 stirring partition plate (third space member)
56*a* stirring partition plate (third space member)
56*b* stirring partition plate (third space member)
57*a* inflow-side communication port (third communication port)
57 inflow-side communication port (third communication port)
58 return-side communication port (third communication port)
58*a* return-side communication port (third communication port)
59 stirring chamber (third space)
59*a* stirring chamber (third space)
59*b* stirring chamber (third space)
60 upper header (header)
61 upper-header main body
62*a* upper return space (second space)
62*b* upper inflow space (first space)
63 upper circulation partition plate (circulation member)
64 upper return opening (second communication port)
65 upper turn-around opening (first communication port)

PATENT LITERATURE

PTL 1: Japanese Unexamined Patent Application Publication No. 2015-068622

PTL 2: Japanese Unexamined Patent Application Publication No. 2017-044428

The invention claimed is:

1. A heat exchanger comprising:

a header that extends in a horizontal direction; and heat transfer tubes that extend in a direction crossing the horizontal direction, that are disposed side by side in a longitudinal direction of the header, and that are connected to the header, wherein the header comprises:

a first space that causes a refrigerant to flow in a first direction along the longitudinal direction of the header;

a second space that causes the refrigerant to flow in a second direction along the longitudinal direction of the header and opposite to the first direction, wherein a portion of the second space is disposed side by side with the first space in the horizontal direction;

a circulation member that extends in the longitudinal direction of the header and separates the first space from the second space;

a first communication port through which the first space communicates with the second space in the header;

a second communication port through which the first space communicates with the second space in the header at a position in the second direction with respect to the first communication port; and an inflow port that causes the refrigerant to flow into the header, at least one of the first space and the second space is directly or indirectly connected to the heat transfer tubes, the inflow port has an opening through which the refrigerant flows into the first space, and the heat transfer tubes are connected to the header such that an end portion of each of the heat transfer tubes communicates with the first space and not to communicate with the second space.

2. The heat exchanger according to claim 1, wherein each of the heat transfer tubes comprises either:

tubes disposed in a direction in which the first space and the second space are disposed side by side, or a circular tube.

3. An air conditioner comprising:

a refrigerant circuit comprising the heat exchanger according to claim 1.

4. A heat exchanger comprising:

a header that extends in a horizontal direction; and heat transfer tubes that extend in a direction crossing the horizontal direction, that are disposed side by side in a longitudinal direction of the header, and that are connected to the header, wherein the header comprises:

a first space that causes a refrigerant to flow in a first direction along the longitudinal direction of the header;

a second space that causes the refrigerant to flow in a second direction along the longitudinal direction of the header and opposite to the first direction, wherein a portion of the second space is disposed side by side with the first space in the horizontal direction;

a circulation member that extends in the longitudinal direction of the header and separates the first space from the second space;

a first communication port through which the first space communicates with the second space in the header;

a second communication port through which the first space communicates with the second space in the header at a position in the second direction with respect to the first communication port; and an inflow port that causes the refrigerant to flow into the header, at least one of the first space and the second space is directly or indirectly connected to the heat transfer tubes, the inflow port has an opening through which the refrigerant flows into the first space, and the heat transfer tubes are connected to the header such that an end portion of each of the heat transfer tubes communicates with the second space and not to communicate with the first space.

5. The heat exchanger according to claim 4, wherein each of the heat transfer tubes comprises either:

tubes disposed in a direction in which the first space and the second space are disposed side by side, or a circular tube.

6. An air conditioner comprising:

a refrigerant circuit comprising the heat exchanger according to claim 4.

7. A heat exchanger comprising:

a header that extends in a horizontal direction; and heat transfer tubes that extend in a direction crossing the horizontal direction, that are disposed side by side in a longitudinal direction of the header, and that are connected to the header, wherein the header comprises:

a first space that causes a refrigerant to flow in a first direction along the longitudinal direction of the header;

a second space that causes the refrigerant to flow in a second direction along the longitudinal direction of the header and opposite to the first direction, wherein a portion of the second space is disposed side by side with the first space in the horizontal direction;

a circulation member that extends in the longitudinal direction of the header and separates the first space from the second space;

a first communication port through which the first space communicates with the second space in the header;

a second communication port through which the first space communicates with the second space in the header at a position in the second direction with respect to the first communication port; and an inflow port that causes the refrigerant to flow into the header, at least one of the first space and the second space is directly or indirectly connected to the heat transfer tubes, the header further comprises:

a third space between both of the first space and the second space and the heat transfer tubes;

a space member that separates the first space and the second space from the third space; and a third communication port via which at least one of the first space and the second space communicate with the third space.

8. The heat exchanger according to claim 7, wherein the heat transfer tubes are connected to the third space and disposed side by side in a direction in which the first space and the second space are disposed side by side.

9. The heat exchanger according to claim 7, wherein the heat transfer tubes are connected to the header such that an end portion of each of the heat transfer tubes communicates with the first space and the second space.

10. The heat exchanger according to claim 7, wherein each of the heat transfer tubes comprises either:

tubes disposed in a direction in which the first space and the second space are disposed side by side, or a circular tube.

11. An air conditioner comprising:

a refrigerant circuit comprising the heat exchanger according to claim 7.

12. A heat exchanger comprising:

a header that extends in a horizontal direction; and heat transfer tubes that extend in a direction crossing the horizontal direction, that are disposed side by side in a longitudinal direction of the header, and that are connected to the header, wherein the header comprises:

a first space that causes a refrigerant to flow in a first direction along the longitudinal direction of the header;

a second space that causes the refrigerant to flow in a second direction along the longitudinal direction of the header and opposite to the first direction, wherein a portion of the second space is disposed side by side with the first space in the horizontal direction;

a circulation member that extends in the longitudinal direction of the header and separates the first space from the second space;

a first communication port through which the first space communicates with the second space in the header;

a second communication port through which the first space communicates with the second space in the header at a position in the second direction with respect to the first communication port; and an inflow port that causes the refrigerant to flow into the header, at least one of the first space and the second space is directly or indirectly connected to the heat transfer tubes, and a tilt angle with respect to a vertical direction in which the heat transfer tubes extend is less than or equal to 45 degrees.

13. The heat exchanger according to claim 12, wherein the heat transfer tubes are connected to the header such that an end portion of each of the heat transfer tubes communicates with the first space and the second space.

14. The heat exchanger according to claim 12, wherein each of the heat transfer tubes comprises either:

tubes disposed in a direction in which the first space and the second space are disposed side by side, or a circular tube.

15. An air conditioner comprising:

a refrigerant circuit comprising the heat exchanger according to claim 12.

16. A heat exchanger comprising:

a header that extends in a horizontal direction; and heat transfer tubes that extend in a direction crossing the horizontal direction, that are disposed side by side in a longitudinal direction of the header, and that are connected to the header, wherein the header comprises:

a first space that causes a refrigerant to flow in a first direction along the longitudinal direction of the header;

a second space that causes the refrigerant to flow in a second direction along the longitudinal direction of the header and opposite to the first direction, wherein a portion of the second space is disposed side by side with the first space in the horizontal direction;

a circulation member that extends in the longitudinal direction of the header and separates the first space from the second space;

a first communication port through which the first space communicates with the second space in the header;

a second communication port through which the first space communicates with the second space in the header at a position in the second direction with respect to the first communication port; and an inflow port that causes the refrigerant to flow into the header, at least one of the first space and the second space is directly or indirectly connected to the heat transfer tubes, the header further comprises:

a third space between the first space and heat transfer tubes;

a space member that separates the first space from the third space; and a third communication port via which the first space communicates with the third space.

17. The heat exchanger according to claim 16, wherein the heat transfer tubes are connected to the header such that an end portion of each of the heat transfer tubes communicates with the first space and the second space.

18. The heat exchanger according to claim 16, wherein each of the heat transfer tubes comprises either:

tubes disposed in a direction in which the first space and the second space are disposed side by side, or a circular tube.

19. An air conditioner comprising:

a refrigerant circuit comprising the heat exchanger according to claim 16.

20. A heat exchanger comprising:

a header that extends in a horizontal direction; and heat transfer tubes that extend in a direction crossing the horizontal direction, that are disposed side by side in a longitudinal direction of the header, and that are connected to the header, wherein the header comprises:

a first space that causes a refrigerant to flow in a first direction along the longitudinal direction of the header;

a second space that causes the refrigerant to flow in a second direction along the longitudinal direction of the header and opposite to the first direction, wherein a portion of the second space is disposed side by side with the first space in the horizontal direction;

a circulation member that extends in the longitudinal direction of the header and separates the first space from the second space;

a first communication port through which the first space communicates with the second space in the header;

a second communication port through which the first space communicates with the second space in the header at a position in the second direction with respect to the first communication port; and an inflow port that causes the refrigerant to flow into the header, at least one of the first space and the second space is directly or indirectly connected to the heat transfer tubes, the header further comprises:

a third space between the second space;

a space member that separates the second space from the third space; and a third communication port via which the second space communicates with the third space.

* * * * *